US007618761B2

(12) United States Patent
Shoji et al.

(10) Patent No.: US 7,618,761 B2
(45) Date of Patent: Nov. 17, 2009

(54) TONER FOR ELECTROSTATIC IMAGE DEVELOPMENT, MANUFACTURING METHOD THEREOF, ELECTROSTATIC IMAGE DEVELOPER AND IMAGE FORMING METHOD

(75) Inventors: Takeshi Shoji, Minamiashigara (JP); Hiroshi Nakazawa, Minamiashigara (JP); Masanobu Ninomiya, Minamiashigara (JP); Shuji Sato, Minamiashigara (JP); Eisuke Iwazaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 318 days.

(21) Appl. No.: 11/703,727

(22) Filed: Feb. 8, 2007

(65) Prior Publication Data

US 2008/0013987 A1 Jan. 17, 2008

(30) Foreign Application Priority Data

Jul. 14, 2006 (JP) ..... 2006-194138

(51) Int. Cl.
*G03G 9/08* (2006.01)

(52) U.S. Cl. ..... 430/109.1; 430/137.16

(58) Field of Classification Search ..... 430/109.1, 430/137.16

See application file for complete search history.

(56) References Cited

U.S. PATENT DOCUMENTS

| | | | | |
|---|---|---|---|---|
| 6,391,510 | B1 * | 5/2002 | Ishiyama et al. | 430/111.4 |
| 6,849,371 | B2 | 2/2005 | Sacripante et al. | |
| 6,890,694 | B2 | 5/2005 | Matsumura et al. | |
| 2002/0187416 | A1 * | 12/2002 | Jiang et al. | 430/137.14 |

FOREIGN PATENT DOCUMENTS

| | | |
|---|---|---|
| JP | A 63-282752 | 11/1988 |
| JP | A 6-250439 | 9/1994 |
| JP | A 2000-250258 | 9/2000 |
| JP | A 2002-278137 | 9/2002 |

* cited by examiner

*Primary Examiner*—John L Goodrow
(74) *Attorney, Agent, or Firm*—Oliff & Berridge, PLC

(57) ABSTRACT

A toner for electrostatic image development comprising a binder resin and a colorant, the toner having a content of an aluminum element with respect to carbon of approximately 0.005 atm % to approximately 0.02 atm % as measured by X-ray photo-electron spectroscopy.

14 Claims, 1 Drawing Sheet

TONER FOR ELECTROSTATIC IMAGE DEVELOPMENT, MANUFACTURING METHOD THEREOF, ELECTROSTATIC IMAGE DEVELOPER AND IMAGE FORMING METHOD

CROSS-REFERENCE TO RELATED APPLICATIONS

This application is based on and claims priority under 35 USC 119 from Japanese Patent Application No. 2006-194138 filed on Jul. 14, 2006.

BACKGROUND OF THE INVENTION

1. Field of the Invention

The present invention concerns a toner for electrostatic image development used upon developing electrostatic latent images formed by an electrophotographic method, an electrostatic recording method or the like, and a manufacturing method thereof, as well as an electrostatic image developer and an image forming method.

2. Description of the Related Art

A method of visualizing image information by way of electrostatic imaging such as an electrophotographic method has now been used in various fields. In the electrophotographic method, an electrostatic image is formed on a photoreceptor in the steps of charging and exposing, then developing the electrostatic latent image with a developer containing a toner, and thus visualizing the image in the steps of transferring and fixing.

As the developer used in the method, there have been known a two-component developer comprising a toner and a carrier, and a single-component developer comprising either one of a magnetic toner and a non-magnetic toner. As a manufacturing method for the toner, generally used is a kneading pulverization method in which a thermoplastic resin is melted and kneaded together with a pigment, a charge controller or a releasing agent such as wax, then after cooling, finely pulverized and classified. According to the method, a toner being excellent to a considerable degree can be produced. However, there are some problems such as decline in developing properties due to a stress in a developing device or the like, degradation of image quality, and contamination of other components, which may be attributed to the indefinite shape of the toner, generation of fine powder, tendency of the releasing agent to be exposed on the surface of the recording medium.

Further, to meet the increasing demand for higher image quality, and especially in formation of a color image, the toner has been remarkably miniaturized to achieve higher image fineness. Further, in a case of a digital full-color copier or printer, a color image is formed by color-separating the original color image using filters of B (blue), R (red) and G (green), then developing latent images that correspond to the original image having a dot diameter of 20 to 70 μm with developers of Y (yellow), M (magenta), C (cyan) and BK (black), in accordance with a subtractive color process. Thus, a great amount of a developer has to be transferred as compared with a conventional black-and-white machine in such cases. Therefore, the importance of uniform chargeability, durability, toner intensity, and sharpness in particle size distribution has also been increasing to respond to a small dot diameter.

On the other hand, importance of improvement in glossiness has also been growing to meet the demand for improvement in quality of a full-color image in copiers and printers.

Proposals have thus been made to improve glossiness while ensuring offset resistance. Further, there has also been proposed an invention intended not merely for improvement in glossiness but also improvement in image quality by eliminating gloss unevenness.

However, it is required for a high-grade full-color image to achieve not only favorable glossiness but also favorable fine line reproducibility at the same time. Particularly, requirement for a high-grade full-color image has been increasing in a case of using a thick paper sheet such as a poster board, where compatibility between high glossiness and fine line reproducibility is difficult to achieve and gloss unevenness tends to occur in half-tone reproduction at the time of fixation, due to low heat conductivity of a thick paper sheet.

As described above, difficulty in achieving high glossiness without causing gloss unevenness and improved fine line reproducibility at the same time, only based on the toner techniques described above, has been increasing.

SUMMARY

According to an aspect of the invention, there is provided a toner for electrostatic image development comprising a binder resin and a colorant, the toner having a content of an aluminum element with respect to carbon of approximately 0.005 atm % to approximately 0.02 atm % as measured by X-ray photo-electron spectroscopy.

DETAILED DESCRIPTION

Figure 1:
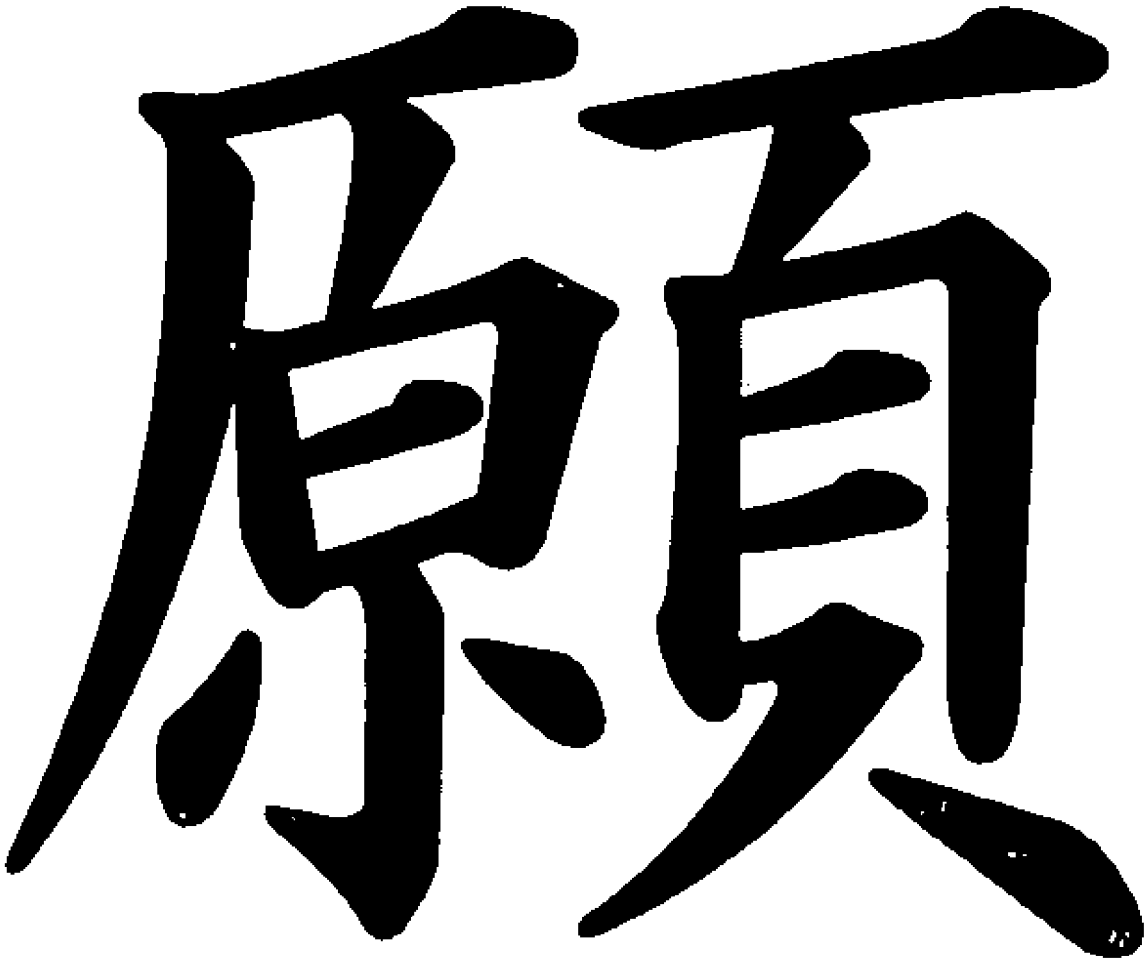
FIG. 1 is an image of the kanji character used for evaluation in the Examples.

The present invention will now be described in detail.

(Toner for Electrostatic Image Development)

The toner for electrostatic image development according to the invention (hereinafter sometimes referred to simply as "toner") is a toner for electrostatic image development that contains a binder resin and a colorant, wherein the content of an aluminum element to carbon as measured according to X-ray photoelectron spectroscopy is 0.005 atm % or more and less than 0.02 atm %.

The present inventors have found that, according to the toner for electrostatic image development of the invention, fixed images having excellent surface glossiness without gloss unevenness can be easily obtained in a case of image fixation using a thick paper, and have accomplished the invention.

To obtain a fixed image having high glossiness, it is required to reduce viscosity of a toner, uniformly fusing the same, and smoothing the surface of the fixed image. However, in a case of using regular paper, gloss unevenness is generally caused since the fused toner having reduced viscosity is dragged by a fixing member to impair the smoothness of the fixed image. That is, adherence of the toner to the fixing member excesses aggregation force between the toners due to the reduced viscosity of the toner, whereby the toner may adhere to the fixing member and the smoothness of the surface of the fixed image may be partially lost, thereby causing gloss unevenness.

However, in a case where a material having low heat conductivity such as a thick paper (in the range from about 105 to about 256 gsm) is used as a recording paper, the toner does not always show the fixing behavior as described above. Rather, high glossiness may not be obtained because of insufficient fixing properties. That is, in a case of forming a photograph-like full-color image on thick paper such as a poster board, it has been found out that the toner requires fusing characteristics, viscoelastic characteristics and the like which are somewhat different from those in a case of using regular paper.

In view of the above, it has been found out in the invention that the above problems may be overcome by controlling the amount of an aluminum element at the toner surface, which has a significant effect on fixing properties at the time of fixation, more specifically, by reducing the amount of the aluminum element by adding a chelating agent during manufacture of the toner. It has been found out that, by acting a chelating agent with aggregated particles obtained in the process of an emulsion aggregation method as described later and reducing the content of the aluminum element as measured by X-ray photoelectron spectroscopy (XPS) down to from 0.005 atm % or more and less than 0.02 atm %, viscosity of the toner may sufficiently be lowered and high glossiness on the surface of the image after fixing may be obtained, and although the reason thereof has not been apparent, an image having high quality without gloss unevenness may be obtained As described above, in the invention, it is required to make the content of the aluminum element to carbon as measured according to XPS to be from 0.005 atm % or more and less than 0.02 atm %. In a case where the content of the aluminum element is less than 0.005 atm %, anti-offset properties may be degraded, even though gloss unevenness in a half-tone image may be suppressed at the time of fixing a full-color image on a thick paper such as a poster board. In a case where the content of the aluminum element to carbon is 0.02 atm % or more, gloss unevenness in a half-tone image may occur at the time of fixing a full-color image on a thick paper such as a poster board, even though anti-offset properties may be controlled.

The content of the aluminum element to carbon is preferably within a range of from 0.007 to 0.017 atm %, more preferably within a range of from 0.01 to 0.015 atm %.

As will be described later, while the aluminum content to carbon as measured according to XPS obtained is that at the periphery of the surface of the toner (about 0.01 to 0.5 μm in depth), it is preferable that the inside of the toner also has the aluminum content that is equivalent to the above.

The content of the aluminum element to carbon as measured by XPS for the toner of the invention is calculated by conducting surface composition analysis by ESCA (X-Ray Electron Spectroscopy for Chemical Analysis).

The apparatus of ESCA and the measuring conditions in the invention are as follows:

Apparatus used: 1600S model X-ray photoelectronic spectrometer manufactured by PHI Co. (Physical Electronics Industries, Inc).

Measuring condition: X-ray source MgKα (400 W)

Spectral region: diameter 800 μm

The atom concentration (atm %) described in the invention is calculated based on the measured peak intensity of each element, by use of a relative sensitivity factor provided by PHI Co. The measurement is conducted by sputtering the toner surface with an Ar ion beam in the depth direction. The depth from the surface after the sputtering treatment with an Ar ion beam is within the range of from 0.01 to 0.5 μm as observed by a transmission type electron microscope.

Under the conditions described above, the aluminum content at the depth of about 0.01 to 0.5 μm from the surface of the toner can be determined. As described above, the aluminum content at the inside of the toner according to the invention is preferably the same. For example, when an XPS measurement is conducted under the same conditions as above at the cross sectional surface obtained by cutting a toner particle using a microtome or the like, the aluminum content thereof is preferably the same.

Further, in the toner of the invention, the content of the aminopolycarboxylic acid derivative having a valency of 6 or more as measured by pyrogenic gas chromatography/mass spectroscopy is preferably within a range of from 0.1 to 10 mass %.

In the invention, the aluminum amount in the toner is decreased by acting a chelating agent on aggregated particles at the time of manufacturing a toner by an emulsion aggregation method as described above, where the aminopolycarboxylic acid may preferably be used as the chelating agent.

The aminopolycarboxylic acid chelates the aluminum that has been introduced into an aggregated particle, then the aluminum chalated by the aminopolycarboxylic acid is removed from the toner. In this case, the aminopolycarboxylic acid having a valency of 6 or more ("valency" means herein the number of groups that can contribute to coordination) has a larger valency than 2 or 4, thus ion chelating effect per unit amount as a chelating agent is higher. Therefore, the ion chelating effect tends to be easily developed at small addition, the amount of the coagulant that contains aluminum in the toner can be easily controlled, thus improving toner fusibility to obtain an image having high glossiness, even at the time of fixation onto a medium having low heat conductivity such as thick paper.

On the other hand, the aminopolycarboxylic acid derivative having a valency of 6 or more (including aminopolycarboxylic acid) that did not chelate the aluminum and was not removed during cleaning of toner particles after fusing can develop the same effect as an apparent crosslinked structure upon fixing, due to a number of branched structures thereof, which may result in improvement in melt elasticity of the toner and improvement in fine line reproducibility by controlling melting of a fine line image.

Therefore, a toner that can form an image without gloss unevenness and excellent in fine line reproducibility can be obtained by controlling the aluminum content in the above-described toner and incorporating the amino polycarboxynic acid derivative having a valency of 6 or more at a predetermined amount as the chelating agent.

The content of the aminopolycarboxylic acid derivative having a valency of 6 or more in the toner is preferably within a range from 0.1 to 10 mass %, more preferably within a range of 0.5 to 5 mass %, as measured by pyrogenic chromatography/mass spectroscopy.

In a case where the content is less than 0.1 mass %, fine line reproducibility may be worsened, even though high glossiness may be obtained at the time of fixing a full-color image on a thick paper such as a poster board. In a case where the content exceeds 10 mass %, offset may occur, even though fine line reproducibility may be favorable at the time of fixing a full-color image on a thick paper such as a poster board.

The content of the aminopolycarboxylic acid derivative having a valency of 6 or more in the toner can be calculated from a peak area analyzed by a pyrogenic gas chromatography/mass spectrometer. A mass spectrometer is preferably used for measurement, but other devices may also be used without particular restriction. In the invention, for example, a pyrogenic gas chromatography/mass spectrometer may be used.

The content of the aminopolycarboxylic acid derivative having a valency of 6 or more according to pyrogenic gas chromatography in the invention can be measured by the following measuring method.

First, pyrogenic gas chromatographic measurement is conducted on standard specimens prepared by adding an aminopolycarboxylic acid derivative as a measuring object by 0.01 mass %, 0.10 mass %, 1.00 mass %, 3.00 mass %, and 10.0 mass % to toner particles to prepare a calibration curve. Then, measurement is conducted in the same manner on a specimen as a measuring object and the content is calculated according to the calibration curve based on the peak area of a corresponding aminopolycarboxylic acid derivative.

The equipments used and the conditions are as described below.

Analyzer: pyrogenic gas chromatography/mass spectrometer (QR-5000, manufactured by Shimadzu Co.)

Pyrogenic temperature: 590° C.×12 seconds

Column: DB-1L (length: 30 m, diameter: 0.25 mm, thickness: 0.25 μm)

Column temperature, temperature rising condition: 40° C. (retained for 2 minutes)→(temperature elevation at 10° C./minutes)→300° C.

Temperature in evaporization chamber: 300° C.

Next, constitution of the toner for electrostatic image development of the invention will be described.

The toner for electrostatic image development of the invention contains at least a binder resin and a colorant, and optionally other ingredients such as a releasing agent. Each of the constituent ingredients of the toner in the invention will be described in detail.

(Binder Resin)

While the binder resin in the invention is not particularly restricted, combined use of an amorphous resin and a crystalline resin is preferred from the viewpoint of obtaining excellent sharp melting properties upon fixing and high glossiness of a fixed image.

In the invention, the crystalline resin means a resin that shows a distinct peak, not a stepwise change, in the heat absorption amount thereof in differential scanning calorimetry (DSC). A copolymer in which other ingredients are copolymerized to the main chain of a crystalline resin is also referred to as a crystalline resin, if the content of the other ingredients is 50 mass % or less. The amorphous resin in the invention means a resin that shows only a stepwise change, not a distinct peak, in the heat absorption amount according to DSC.

The amorphous resin that constitutes the main component of the binder resin in the invention is not particularly restricted as long as it is an amorphous resin.

Specific examples of the amorphous resin include, for example, homopolymers or copolymers of styrenes such as styrene, parachlorostyrene, and α-methylstyrene; homopolymers or copolymers of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinylnitriles such as acrylonitrile and methacrylonitrile; homopolymers or copolymers of vinyl ethers such as vinyl methyl ether and vinyl isobutyl ether; homopolymers or copolymers of vinyl methyl ketone, vinyl ethyl ketone, and vinyl isopropenyl ketone; homopolymers or copolymers of olefins such as ethylene, propylene, butadiene and isoprene; or mixtures thereof.

Non-vinylic condensation resins such as silicone resins including methyl silicone, methylphenyl silicone and the like, polyesters containing bisphenol, glycol, and the like, epoxy resin, polyurethane resin, polyamide resin, cellulose resin, polyether resin and polycarbonate resin, mixtures of these resins and the above vinyl resins, or graft polymers obtained by polymerizing vinylic monomers under coexistence thereof may also be used.

In the invention, in a case of using polyester as the binder resin, a resin particle dispersion can be prepared by preparing the polyester and dispersing the same together with a dispersion stabilizer under high temperature and high pressure conditions. In this case, a binder resin that can develop the effect of the invention as described above may be obtained in a similar manner, i.e., adding a chelating agent and fusing after a coalescence step to be described later.

A resin that has crystallinity may be used as the crystalline resin without particular restriction and specific examples thereof include a crystalline polyester resin, a crystalline vinyl resin and the like. From the viewpoint of adhesiveness to paper upon fixing, chargeability, and controlling of a melting point in a preferred range, the crystalline polyester resin is preferred, and an aliphatic crystalline polyester resin having an appropriate melting point is more preferred.

The melting point of the crystalline resin is preferably within a range from 50 to 120° C., and more preferably within a range from 60 to 110° C. In a case where the melting point is lower than 50° C., storability of a toner or a toner image after fixing may become problematic. On the other hand, in a case where the melting point is higher than 120° C., high fixing temperature may not be preferable in view of energy efficiency.

A compound having a hydrophilic polar group may also be used as long as it is copolymerizable in the binder resin of the toner for electrostatic image development of the invention. In a case where the resin is polyester, specific examples thereof include dicarboxylic acid compounds having an aromatic ring on which a sulfonyl group is directly substituted, such as sodium sulfonyl-terephthalate and sodium 3-sulfonyl isophthalate. In a case where the resin is a vinylic resin, specific examples thereof include unsaturated aliphatic carboxylic acids such as (meth)acrylic acid and itaconic acid, esters of (meth)acrylic acids and alcohols such as glycerine mono (meth)acrylate, aliphatic acid modified glycidyl (meth)acrylate, zinc mono(meth)acrylate, zinc di(meth)acrylate, 2-hydroxyethyl(meth)acrylate, polyethylene glycol(meth) acrylate, and polypropylene glycol(meth)acrylate, and sulfonyl substituted aromatic vinyls such as styrene derivatives having a sulfonyl group at ortho-, metha- or para-position, and vinyl naphthalene containing a sulfonyl group.

(Colorant)

The colorant usable in the invention may be selected in view of hue angle, saturation, brightness, weather resistance, OHP transparency, dispersibility in the toner, and the like.

A black pigment can be exemplified by carbon black, copper oxide, manganese dioxide, aniline black, activated carbon, non-magnetic ferrite, magnetite and the like.

A yellow pigment can be exemplified by chrome yellow, zinc yellow, yellow iron oxide, cadmium yellow, chrome yellow, Hanza yellow, Hanza yellow 10G, benzidine yellow G, benzidine yellow GR, threne yellow, quinoline yellow, permanent yellow NCG and the like.

An orange pigment can be exemplified by red chrome yellow, molybdenum orange, permanent orange GTR, pyrazolone orange, vulcane orange, benzidine orange G, indanthrene brilliant orange RK, indanthrene brilliant orange GK and the like.

A red pigment can be exemplified by red iron oxide, cadmium red, red lead oxide, mercury sulfide, watchang red, permanent red 4R, lithole red, brilliant carmine 3B, brilliant carmine 6B, Du Pont oil red, pyrazolone red, rhodamine B lake, lake red C, rose Bengal, eoxine red, alizarin lake and the like.

A blue pigment can be exemplified by Prussian blue, cobalt blue, alkali blue lake, Victoria blue lake, fast sky blue, indanthrene blue BC, aniline blue, ultramarine blue, chalco oil blue, methylene blue chloride, phthalocyanine blue, phthalocyanine green, malachite green oxalate and the like.

A purple pigment can be exemplified by manganese purple, fast violet B, methyl violet lake, and the like.

A green pigment can be exemplified by chromium oxide, chrome green, pigment green, malachite green lake, final yellow green G, and the like.

A white pigment can be exemplified by zinc powder, titanium oxide, antimony white, zinc sulfide, and the like. A body pigment can be exemplified by ballite powder, barium carbonate, clay, silica, white carbon, talc, alumina white, and the like. Examples of a dye include various dyes such as a basic dye, an acidic dye, a dispersion dye, a direct dye and the like, e.g. nigrosin.

The colorants described above can be used alone, by mixture or in a state of solid-solution. The colorant is dispersed by a known method and preferable examples thereof include a rotary shearing type homogenizer, a media type dispersing machine such as a ball mill, a sand mill and an attritor, a counter collision type dispersing machine, and the like.

Further, in a case where the colorant is used for an emulsion aggregation method to be described later or the like, it is dispersed in an aqueous phase using a surfactant having a polarity, by the homogenizer described above.

In the invention, the addition amount of the colorant dispersed in the toner is preferably within a range from 4 to 15 mass % based on the total mass of the toner.

In the invention, a releasing agent may optionally be used.

Specific examples of the usable releasing agent include low molecular weight polyolefins such as polyethylene, polypropylene and polybutene; Silicones having a softening point; aliphatic acid amides such as oleic amide, ercaic acid amide, risinoleic amide, and stearic amide; plant waxes such as carnauba wax, rice wax, candelilla wax, Japan wax, and jojoba oil; animal waxes such as bee wax; mineral and petroleum waxes such as montane wax, ozokerite, ceresin, paraffin wax, microcrystalline wax, and Fisher-Tropsh wax; ester waxes of higher fatty acid and higher alcohols such as stearyl stearate and behenyl-behenate; ester waxes of higher fatty acids and mono- or polyvalent lower alcohols such as butyl stearate, propyl oleate, monostearic acid glyceride, distearic acid glyceride, and pentaerythritol tetrabehenate; ester waxes of higher fatty acids and polyhydric alcohol multimers such as diethylene glycol monostearate, dipropylene glycol distearate, distearic diglyceride, and tetrastearic triglyceride; sorbitan higher fatty acid ester waxes such as sorbitan monostearate; and choresterol higher fatty acid ester waxes such as choresteryl stearate.

In the invention, the releasing agents may be used alone or in combination.

The addition amount of the releasing agent is preferably within a range from 5 to 25 mass parts, and more preferably within a range from 7 to 20 mass parts based on 100 mass parts of the binder resin.

Internal additives, charge controllers, inorganic fine particles and other ingredients (particles) may be added as appropriate according to purposes, in addition to the above-described binder resin, colorant and releasing agent.

The internal additives can be exemplified by metals such as cobalt, manganese and nickel, alloys thereof or compounds containing such metals, and they may be used in such an amount that the glossiness upon fixing as the toner characteristics is not impaired.

The charge controller is not particularly restricted, and those of colorless or pale color may be preferably used, particularly in a case of using a color toner. Examples thereof include quaternary ammonium salt compounds, nigrosin compounds, dyes comprising a complex of aluminum, iron or chromium, and triphenyl methane pigments. From the viewpoint of controlling ion strength that has an effect on stability upon aggregation and fusion/coalescence to be described later and decreasing waste water contamination, materials having low water solubility are preferable.

Further, in the toner of the invention, inorganic fine particles may be added in a wet process to stabilize chargeability. Examples of the inorganic fine particles to be added include all materials that are usually used as external additives for toner surface such as silica, alumina, titania, calcium carbonate, magnesium carbonate, and tricalcium phosphate, which are preferably used by dispersing with an ionic surfactant, a polymeric acid and a polymeric base.

The content of the other ingredients may be such an amount that the purpose of the invention is not hindered and is usually extremely small. Specifically, it is within a range from 0.01 to 5 mass %, and preferably from 0.5 to 2 mass %.

The toner of the invention preferably has one or more type of metal oxide particles or organic particles at the surface thereof, for the purpose of imparting fluidity or improving cleaning property.

Specific examples of the metal oxide particles include silica, titania, zinc oxide, strontium oxide, aluminum oxide, calcium oxide, magnesium oxide, cerium oxide, and composite oxides thereof. Among them, silica and titania are preferably used in view of particle size, particle size distribution and productivity. The metal oxide particles are preferably subjected to surface modification such as a hydrophobic treatment, for which known methods may be used. Specifically, the method can be exemplified by a coupling treatment using silane, titanate, aluminate or the like.

The organic particles can be exemplified by resin particles of vinyl resins, polyester resins, and silicone resins, which may be used alone or in combination. The amount of these to be added to the toner is not particularly restricted, but preferably within a range from 0.1 to 10 mass %, and more specifically, within a range of about from 0.2 to 8 mass %.

The metal oxide particles or the organic particles are preferably added to the surface of the toner particles while shearing.

The volume average particle size of the toner of the invention is preferably within a range of from 3 to 9 μm, more preferably within a range of from 3 to 8 μm. In a case where the volume average particle size of the toner particles exceeds 9 μm, the ratio of coarse particles may increase to deteriorate reproducibility of fine lines or microdots and gradation sequence of an image obtained during fixation. On the other hand, in a case where the volume average particle size of the toner particles is less than 3 μm, various failures deriving from degradation of powder characteristics may occur during other steps, such as degradation of powder fluidity, develop-ability or transferability of the toner, lowering of cleaning properties of the toner remaining on the surface of the image support.

The index for the particle size distribution of the toner particles used in the invention is preferably that the volume average particle size distribution index GSDv is 1.30 or less, and more preferably that the ratio GSDv/GSDp, where GSDp is the number average particle size distribution index, is 0.95 or more. In a case where the volume distribution index GSDv exceeds 1.30, gloss unevenness may easily occur due to increase in surface irregularlity in a fixed image. Further, in a case where the ratio between the volume average particle size distribution index GSDv and the number average particle size distribution GSDp is less than 0.95, the amount of the small toner may increase to cause unevenness in the amount of a releasing agent contained in each toner particle, which may result in improper peeling and a desired glossiness may not be obtained.

The values of the volume average particle size and the particle size distribution index may be calculated according to the measurement as described below. First, an accumulative distribution is drawn from the smaller diameter side, with regard to the volume of respective toner particles and the number thereof, according to a particle size range (channel) obtained by dividing the particle size distribution of the toner measured by using Multi sizer-II (manufactured by Beckman Coulter Co.) as a measuring instrument. Then, the particle size at a cumulative percentage of 16% is defined as a volume average particle size D16v and a number average particle size D16p, and the particle size at a cumulative percentage of 50% is defined as a volume average particle size D50v (this volume is defined as a volume average particle size) and a number average particle size D50p. In the same manner, the particle size at a cumulative percentage of 84% is defined as a volume average particle size D84v and a number average particle size D84p. Using them, the volume average particle size distribution index GSDv is defined as $(D84v/D16v)^{1/2}$ and the number average particle size distribution index GSDp is defined as $(D84p/D16p)^{1/2}$.

Further, the shape factor SF1 for the toner in the invention is preferably within a range from 110 to 145.

In a case where the shape factor SF1 is less than 110, blade cleaning properies for the transfer residue toner on a photoreceptor may be deteriorated, and in a case where it exceeds 145, toner fluidity may be lowered and may adversely affect transferability from the initial stage.

The shape factor SF1 is determined according to the following equation (1).

$$SF1=(ML^2/A)\times(\pi/4)\times 100 \qquad \text{formula (1)}$$

In the formula (1), ML represents a maximum length of a toner particle and A represents a projection area of the toner particle, respectively.

The SF1 is digitized mainly by analyzing a microscopic image or a scanning electron microscopic (SEM) image using an image analyzer and can be calculated, for example, in a manner as described below. That is, an optical microscopic image of toner particles scattered on the surface of a slide glass are taken into a Luzex image analyzer using a video camera to determine the maximum length and the projection area of the toner particles of 50 or more, and SF1 for each toner particle is calculated according to the above formula (1), and SF1 is determined as the average value thereof.

While the toner particles in the invention can be manufactured by any manufacturing method such as a kneading pulverization method, a suspension polymerization method, a dissolution polymerization method, or an emulsion aggregating coalescence method, as long as the method can control the aluminum content as measured by XPS within a range described above. Among these, particularly preferred is a method in which the aluminum content is reduced by the action of a chelating agent after aggregation step according to an emulsion aggregating coalescence method as described above, not only because of handleability thereof as a manufacturing method but also that the effect described above is remarkable when the aluminum content is controlled, and a specified chelating agent (hexa-valent aminopolycarboxylic acid derivative) can remain in the toner.

(Manufacturing Method of Toner for Electrostatic Image Development)

The method of manufacturing the toner for electrostatic image development of the invention is not particularly restricted. From the viewpoint that the characteristics of the invention lie in defining the content of aluminum element in the toner, and the viewpoint of presence of the element, easiness for the control thereof and the like, the manufacturing method according to an emulsion aggregation method is preferred.

A method of manufacturing the toner for electrostatic image development of the invention will now be described more specifically, taking an emulsion aggregation method for an example.

The method of manufacturing the toner for electrostatic image development of the invention includes a coalescence step of mixing at least one or more resin particle dispersions and one or more colorant dispersions to form aggregated particles under the presence of an aluminum ion and a fusing step of heating the aggregated particles up to a glass transition temperature or higher of the resin particles to fuse and coalesce to form toner particles.

That is, the manufacturing method described above is generally a method of using a dispersion of resin particles prepared by an emulsion polymerization or the like using an ionic surfactant, mixing therewith a dispersion of a colorant using an ionic surfactant having an opposite polarity, then causing hetero-aggregation to form aggregated particles having a diameter that corresponds to a toner diameter, and then heating the aggregated particles up to a glass transition temperature of the resin or higher to fuse and coalesce, thereafter cleaning and drying them to obtain a toner. According to this method, toners having shapes of from indefinite to spherical can be manufactured as appropriate. Further, in the toner of the invention, a dispersion of fine particles of a releasing agent may also be added as appropriate.

The manufacturing method described above is a method wherein the dispersions of starting materials are mixed at a time, then aggregated and fused. In the manufacturing method, the aggregation step may also be conducted by: (i) forming and stabilizing the core aggregated particles by elevating the temperature to a level lower than the glass transition temperature of the resin after ionically nautralizing the ionic dispersant with a metal salt containing at least aluminum or a polymer containing at least aluminum, wherein the amount of the ionic dispersant in the first stage has previously been unbalanced; then optionally slightly heating the aggregated particles at high temperature (a temperature lower than the glass transition temperature of the resin contained in the core aggregated particles or the additional resin particles); and (ii) adding a particle dispersant that can compensate the unbalance of the dispersion and optionally stabilizing the aggregated particles by heating to a temperature lower than the glass transition temperature of the resin contained in the core or additional particles, and thereafter fusing and coalescing the particles, in which the particles added in the second step are deposited onto the surface of the core aggregated particles, by heating to a temperature higher than the glass transition temperature of the resin.

In the manufacturing method of the toner of the invention, it is preferred that the chelating agent is added to the aggregated particles at least no later than just before starting actual fusion in the fusing step. By adding the chelating agent to the aggregated particles before fusing and coalescence, the chelating agent chelates the aluminum that has been introduced into the aggregated particles for aggregation in the aggregation step, and the chelated aluminum is removed from the toner in the subsequent cleaning step, and consequently the content of the aluminum element in the toner can be decreased.

In the method of reducing the preparation amount of the aluminum by reducing the preparation amount of the coagulant upon manufacturig the toner, it is difficult to control from the viewpoint of ensuring stable particle growth in the aggregation step. On the other hand, when the chelating agent is added to the toner particles that have completed fusing in the fusing step, toner particles with the reduced aluminum content as desired cannot be obtained since the chelating agent cannot get into the toner particle. Accordingly, by adding the chelating agent no later than the start of actual fusing in the fusing step after aggregation, the content of the aluminum in the toner (including the inside of the toner particles) can be controlled.

The resin particle dispersion can be prepared, in a case of using a vinyl monomer as the starting material, by emulsion polymerization using an ionic surfactant or the like. In cases of other resins, the resin particle dispersion can be prepared by using the resin that is soluble to an oil-based low-water-soluble solvent, dissolving the resin in the solvent and dispersing it in water together with an ionic surfactant and a polymeric electrolyte to form particles by a dispersing machine such as a homogenizer, and then evaporating the solvent by heating or depressurization.

Examples of the dispersion medium used in a resin particle dispersion, colorant dispersion, releasing agent dispersion and other ingredients to be described later include, for example, an aqueous medium.

Examples of the aqueous medium include, for example, water such as distilled water or ion exchanged water and alcohol, which may be used alone or in combination.

A surfactant can be used for the purpose of stabilization of each of the dispersion described above.

Examples of the surfactant include, for example, anionic surfactants such as sulfate ester salts, sulfonate salts, phosphate esters, and soaps; cationic surfactants such as amine salts and quaternary amine ammonium salts; and nonionic surfactants such as polyethylene glycols, alkylphenyl ethylene oxide adducts, and polyhydric alcohols. Among them, preferred are the ionic surfactants and more preferred are the anionic surfactants and cationic surfactants.

For the toner in the invention, it is generally advantageous to use an anionic surfactant having intense dispersion force and excellent properties to disperse resin particles or a colorant, as the surfactant for dispersing the releasing agent.

The nonionic surfactant is preferably used in combination with the anionic surfactant or the cationic surfactant described above. The surfactants may be used either alone or in combination.

Specific examples of the anionic surfactant include, for example, fatty acid soaps such as potassium laurate, sodium oleate, sodium castor oil; sulfate esters such as octyl sulfate, lauryl sulfate, lauryl ether sulfate, and nonyl phenyl ether sulfate; sodium alkyl naphthalene sulfoantes such as laurul sulfonate, dodecyl benzene sulfonate, troisopropyl napnthalene sulfonate, and dibuyl naphthalene sulfonate; sulfonate salts such as naphthalene sulfonate-formaline condensation products, monooctyl sulfosuccinate, dioctyl sulfosuccinate, lauric amide sulfonate, and oleic amide sulfonate; phosphate esters such as lauryl phosphate, isopropyl phosphate, and nonyl phenyl ether phosphate; dialkyl sulfosuccinate salts such as sodium dioctyl sulfosuccinate; and sulfosuccinate salts such as disodium lauryl sulfosuccinate.

Specific examples of the cationic surfactant include, for example, amine salts such as laurylamine hydrochloride, stearylamine hydrochloride, oleylamine hydrochloride, stearylamine acetate, and stearylaminopropyl amine acetate; and quaternary ammonium salts such as lauryl trimethyl ammonium chloride, dilauryl dimethyl ammonium chloride, distearyl dimethyl ammonium chloride, distearyl dimethyl ammonium chloride, lauryl dihydroxy ethyl methyl ammonium chloride, oleyl bispolyoxyethylene methyl ammonium chloride, lauroyl aminopropyl dimethyl ethyl ammonium etosulfate, lauroyl aminopropyl dimethyl hydroxylethyl ammonium perchrolate, alkylbenzene trimethyl ammonium chloride, and alkyltrimethyl ammonium chloride.

Specific examples of the nonionic surfactant include, for example, alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octylphenyl ether, and polyoxyethylene nonylphenyl ether; alkyl esters such as polyoxyethylene laurate, polyoxyethylene stearate, and polyoxyethylene oreate; alkylamines such as polyoxyethylene lauryl amino ether, polyoxyethylene stearyl amino ether, polyoxyethylene oleyl amino ether, polyoxyethylene soybean amino ether, and polyoxyethytlene tallow amino ether; alkylamides such as polyoxyethylene lauric amide, polyoxyethylene stearic amide, and polyoxyethylene oleic amide; vegetable oil ethers such as polyoxyethylene castor oil ether and polyoxyethylene rape oil ether; alkanole amides such as lauric diethanol amide, stearic diethanol amide, and oleic diethanol amide, and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The content of the surfactant in each dispersion may be in such an amount that the aim of the invention is not hindered and is generally a small amount. Specifically, it is within a range of from about 0.01 to about 10 mass %, more preferably within a range from about 0.05 to about 5 mass %, and further preferably within a range from about 0.1 to about 2 mass %. In a case where the content is less than 0.01 mass %, there may be problems such as aggregation due to unstability of each dispersion such as resin particle dispersion, colorant dispersion, releasing agent dispersion, or liberation of specific particles due to difference in stability of each particle. In a case where it exceeds 10 mass %, the particle size distribution of the particles may become broader or control of the particle size may become difficult. Generally, a dispersion of a suspension polymerization toner having a large particle size is stable even when the amount of the surfactant used is small.

Further, an aqueous polymer which is in a solid state at normal temperature may also be used. Specific examples thereof include cellulose compounds such as carboxymethyl cellulose and hydroxypropyl cellulose, polyvinyl alcohol, gelatin, starch, gum arabic, and the like.

The colorant dispersion is prepared by dispersing particles of a colorant of a desired color such as blue, red or yellow in a solvent, using an ionic surfactant polarized oppositely to the ionic surfactant that is used for preparation of the resin particle dispersion and. Further, the releasing agent dispersion is prepared by dispersing a releasing agent in water together with an ionic surfactant or a polymeric electrolyte such as a polymeric acid or polymeric base, then finely particulating them by a homogenizer or a pressure-discharge-type dispersing machine capable of heating up to a melting point or higher and shearing.

The particle size of the resin particles in the resin particle dispersion of the invention is 1 μm or less and preferably within the range from 100 to 300 nm in terms of a volume average particle size. In a case where the volume average particle size exceeds 1 μm, the particle size distribution of toner particles obtained by aggregation and fusion may become broader or liberated particles may be formed to cause degradation of performance or reliability of the toner. In a case where particle size is less than 100 nm, the time required for aggregating and growing the toner may become too long to be applicable to industrial use. In a case where it exceeds 300 nm, dispersions of the releasing agent and the colorant may become inhomogeneous and controlling of toner surface properties may become difficult.

The particle size of the resin particles in the resin particle dispersion and the like can be measured, for example, by a laser-diffraction-type particle size distribution measuring apparatus (LA-700, manufactured by Horiba, Ltd.).

In the aggregation step, the particles in the resin particle dispersion, the colorant dispersion, and optionally the releasing agent dispersion that are mixed with each other aggregate to form aggregated particles. The aggregated particles are formed by hetero aggregation or the like, and an ionic surfactant polarized differently from the aggregated particles or a compound charged to have a valency of one or more such as a metal salt may be added, for the purpose of stabilizing the aggregated particles and controlling particle size/particle size distribution.

The aggregation process may be conducted by mixing the dispersions at a time and forming aggregated particles, or by the process comprising: (i) forming and stabilizing the core aggregated particles by elevating the temperature to a level lower than the glass transition temperature of the resin after ionically nautralizing the ionic dispersant with the above-described ionic surfactant or a compound having a valency of one or more such as a metal salt, wherein the amount of the ionic diepersant in the first stage has previously been unbalanced; then (ii) coating the core aggregated particles by an additional resin particle dispersion treated with a dispersant having a polarity and amount by which the unbalance of the dispersion is compensated; and optionally stabilizing the aggregated particles by heating to a temperature of lower than the glass transition temperature of the resin contained in the core or additional particles, and thereafter coalescing the particles, in which the particles added in the second step for aggregation are deposited onto the surface of the core aggregated particles (deposited particles), by heating to a temperature higher than the glass transition temperature of the resin. This stepwise operation for aggregation comprising the steps of (i) and (ii) may be repeated more than once.

In the method of manufacturing the toner for electrostatic development according to the invention, particles may be prepared by generating aggregation by change in pH in the aggregation step. At the same time, a coagulant is added for making aggregation of the particles stable and rapid, or for obtaining aggregated particles having a narrower particle size distribution.

The coagulant is not particularly restricted, but a metal salt of an inorganic acid is used in view of stability of the aggregated particles, stability of the coagulant against heat or aging, or removability thereof during cleaning. Specific examples thereof include metal salts of inorganic acids such as magnesium chloride, sodium chloride, aluminum sulfate, calcium sulfate, ammonium sulfate, aluminum nitrate, silver nitrate, copper sulfate, and sodium carbonate. In the invention, a coagulant containing aluminum such as polyaluminum chloride, aluminum sulfate, aluminum potassium sulfate and the like are used from the viewpoint of controlling the final viscosity of the toner at the time of fixation.

The addition amount of the coagulant varies depending on the valency of the charge, but it is small in each case, which is about 0.5 mass % or less in a case of a trivalent material such as aluminum. Since smaller amount of the coagulant is more preferable, a compound having higher valency is preferably used.

In the invention, it is preferred to further mix a chelating agent after elevation of the temperature in the aggregation step. The reason for mixing the chelating agent at this stage is because aggregation can avoid being hindered by chalation of the chelating agent, since desired aggregated particles have already been formed at this stage. Addition of the chelating agent is not necessarily conducted at this stage, and it may be conducted at least no later than the onset of actual fusion, for example, at the time of starting heating for fusion.

The expression "chelating agent" used in the invention is a collective name for those having metal ion chelating effect which are generally referred to as a chelating agent, and they are preferably water soluble. In a case where they are not water soluble, dispersibility in the liquid may be poor and aluminum chalation in the toner may not be sufficient.

As the chelating agent, oxycarboxylic acids such as tartaric acid, citric acid, and gluconic acid, imino diacid (IDA), nitrilotriacetic acid (NTA), as well as aminopolycarboxylic acids such as ethylene diamine teteraacetic acid (EDTA), nitrilotriacetic acid, diethylene triamine pentaacetic acid, hydroxyethyl ethylene diamine triacetic acid, triethylene tetraamine hexaacetic acid, and the like can be suitably used. Among them, aminopolycarboxylic acids such as EDTA are preferable in that deterioration of electrical or other characteristics of the toner may not be caused.

In the invention, it is preferred to include a hexavalent aminopolycarboxylic acid derivative in the toner particles after cleaning, as described above. Accordingly, it is preferable to use the hexavalent aminopolycarboxylic acid derivative as a chelating agent to chelate the aluminum and remove the aluminum, and at the same time allow the hexavalent aminopolycarboxylic acid derivative to remain in the toner.

Examples of the hexavalent aminopolycarboxylic acid derivative include triethylene tetramine hexaacetic acid (hexavalent), which effectively acts with a view point of obtainability of the avove-described apparent crosslinked structure at fixation, and favorable aluminum chelating ability.

The chelating agent is preferably used in a state of being dissolved in water and the like and diluted. Further, in a case of using a composite material comprising a resin and a colorant, the chelating agent can be allowed to act on the aggregated particles by the methods such as: after dissolving and dispersing a resin and a colorant in a solvent, dispersing the same in water with an appropriate dispersant described above and removing the solvent by heating and depressurization; applying a mechanical shearing force to the surface of the resin particles prepared by emulsion polymerization; or performing electrical adsorption and immobilization. These methods are effective, for example, to suppress liberation of the colorant as the additional particles, or to improve dependency on the colorant of chargeability.

The addition amount of the chelating agent is preferably within a range from 0.1 to 15 mass parts based on 100 mass parts of the binder resin, and more preferably within a range from 0.5 to 10 mass parts. In a case where the addition amount of the chelating agent is less than 0.1 mass %, the effect of adding the chelating agent may not be obtained even when a hexavalent aminopolycarboxylic acid derivative is used and fine line reproduction after fixing may be deteriorated. On the other hand, if it exceeds 15 mass parts, chargeability may be adversely affected and increase in viscoelasticity of the toner may lead to deterioration of fixing properties at low temperature and glossiness in an image, even though the fine line reproduction is improved.

After formation of the aggregated particles (including deposited particles) and addition of the chelating agent, coalescing of the aggregated particles is performed in the fusing step. In the fusing step, progress of aggregation is stopped by controlling the pH of the aggregated particle suspension within a range from 6.0 to 9.5 under the same stirring condition as that in the aggregation step, then the aggregated particles are heated in a solution to a temperature of not lower than a glass transition point of the amorphous resin particles (including shell layer constituting resin) included in the aggregated particles (when two or more kinds of resin are used, the glass transition point or higher of the resin having the highest glass transition temperature), or when a crystalline resin is included, heated to a temperature higher than the melting point of the crystalline resin having the highest melting point, then fused and coalesced to obtain toner particles.

After completion of the above steps of aggregation and fusing, a cleaning step, solid-liquid separation step or drying step will optionally follow, then a desired toner may be obtained. In the cleaning step, it is preferred to sufficiently perform substitution cleaning with ion exchanged water in view of chargeability. Further, while the solid/liquid separation step is not particularly restricted, suction filtration, pressure filtration or the like is preferable from the viewpoint of productivity. Further, while the drying step is not particularly restricted either in view of the method, freeze drying, flash jet drying, fluidized drying, vibrational fluidized drying and the like are preferably used from the viewpoint of productivity.

The toner for electrostatic development according to the invention may be produced by preparing the toner particles (core particles) as described above, adding the inorganic fine particles and the like to the toner particles and mixing the same by a Henschel mixer or the like.

(Electrostatic Image Developer)

The electrostatic image developer of the invention is not particularly restricted as long as the toner for electrostatic latent image development of the invention is contained therein, and may have an appropriate ingredient composition in accordance with the purpose. The electrostatic image developer of the invention can be used as a one-component electrostatic developer in which the electrostatic developing toner is used alone, or as a two-component electrostatic developer in combination with a carrier.

The carrier is not particularly restricted and may be the carriers known per se, for example, known carriers such as resin-coated carriers described in JP-A No. 62-39879, JP-A No. 56-11461 and the like.

Specific examples of the carrier include the following resin-coated carriers. The core particle for the carrier may be the one of usual iron powder, ferrite or magnetite fabrication products having a volume average particle size of from about 30 to 200 μm.

Further, the coating resin for the resin-coated carrier can be exemplified by homopolymers or copolymers of styrenes such as styrene, parachlorostyrene, and α-methyl styrene; α-methylene fatty acids monocarboxylic acids such as methyl acrylate, ethyl acrylate, n-propyl acrylate, lauryl acrylate, 2-ethyl hexyl acrylate, methyl methacrylate, n-propyl methacrylate, lauryl methacrylate, and 2-ethyl hexyl methacrylate; nitrogen-containing acryls such as dimethylaminoethyl methacrylate; vinyl nitriles such as acrylonitrile and methacrylonitrile; vinyl pyridines such as 2-vinylpyridine and 4-vinylpyridine; vinyl ethers such as vinyl methyl ether, and vinyl isobutyl ether; vinyl ketones such as vinyl methyl ketone, vinyl ethyl ketone, and vinyl isopropenyl ketone; olefins such as ethylene and propylene; fluoro-containing vinyl monomers such as vinylidene fluoride, tetrafluoro ethylene, and hexafluoro ethylene; as well as silicone resins containing methyl silicone, methylphenyl silicone and the like, polyesters containing bisphenol, glycol and the like, epoxy resins, polyurethane resins, polyamide resins, cellulose resins, polyether resins, and polycarbonate resins. The resins may be used alone or in combination. The coating amount of the coating resin is preferably in the range from about 0.1 to 10 mass parts, and more preferably in the range from 0.5 to 3.0 mass parts, based on 100 mass parts of the core particles.

For production of the carrier, a heating type kneader, a heating type Henschel mixer, a UM mixer and the like can be used. Depending on the amount of the coating resin, a heating type fludized bed or a heating type kiln and the like can be used.

The mixing ratio between the toner for electrostatic latent image development of the invention and the carrier in the electrostatic developer has no particular restriction and can be selected as appropriate depending on the purpose.

(Image Forming Method)

The image forming method of the invention includes a latent image forming step, a developing step, a transfer step, and a fixing step. Each of the steps per se is generally known and described, for example, in JP-A No. 56-40868, JP-A No. 49-91231, and the like. The image forming method of the invention can be practiced by using a known image forming apparatus such as a copier or a facsimile unit.

In the latent image forming step, latent images are formed on the surface of an electrostatic image support. In the developing step, the latent image on the surface of the developer support is developed by a developer layer to form a toner image. The developer layer has no particular restriction so long as it contains the electrostatic image developer of the invention that contains the toner for electrostatic development of the invention. In the transfer step, the toner image is transferred onto the surface of an image receiving body. In the fixing step, the toner image transferred onto the surface of the image receiving body is transferred onto an image recording medium by heating from a fixing member.

In a case where there is a secondary transfer step using an intermediate transferring body, the intermediate transfer body is also included in the image receiving body. In heat fixing by the fixing device, a releasing agent is usually supplied to a fixing member in the fixing device for preventing offset and the like.

The image recording medium (recording material) to which the toner image is transferred includes, for example, a plain paper sheet or an OHP sheet used, for example, in an electrophotographic copier or a printer.

Particularly, the invention is suitable for the formation of a high-grade full-color image using a thick paper sheet such as a poster board. That is, when usual fixing under heat and pressure is conducted on a thick paper, fixing properties per se may be lowered due to low heat conduction to the recording material, which may also cause uneven glossiness. According to the image forming method of the invention, in which the developer containing the toner of the invention is used, fixing properties are excellent and an image with high glossiness and no unevenness can be obtained even in a case of fixing to a thick paper sheet. Further, since reproduction of fine lines is also excellent, a high-grade full-color image which is closer to a photograph can be obtained.

EXAMPLES

The present invention will now be described referring to the examples, but the invention is not restricted thereto. In the following, "parts" represents "mass parts" and "%" represents "mass %", respectively, unless otherwise specified.

(Measuring Method for Various Characteristics)

First, a method of measuring physical properties of the toners and the like prepared in Examples and Comparative Examples is to be described.

(Method of Measuring Particle Size and Particle Size Distribution of Toner)

In the measurement for the particle size and the particle size distribution of the toner in the invention, Coulter multi sizer II (manufactured by Beckman Coulter Co.) is used as a measuring apparatus and ISOTON-II (manufactured by Beckman Coulter Co.) is used as an electrolyte.

As a measuring method, 0.5 to 50 mg of a sample for measurement is added to 2 ml of an aqueous 5% solution of a surfactant, preferably sodium alkyl benzene sulfonate, as a dispersant. The mixture is added to 100 to 150 ml of the electrolyte. The electrolyte in which the specimen is suspended is subjected to a dispersing treatment by a supersonic dispersing device for about one minute, then the particle size distribution of particles of from 2 to 60 μm is measured by Multi-sizer II using an aperture having a diameter of 100 μm to determine the volume average particle size, GSDv, and GSDp as described above. The number of the particles to be measured is 50,000.

(Method of Measuring Toner Shape Factor SF1)

The toner shape factor SF1 is obtained by taking an optical microscopic image of toner particles scattered on a slide glass into a LUZEX image analyzer via a video camera, and calculating the average of the shape factors SF1 of 10 toners which are respectively calculated from the square of the maximum length of the toner ($ML^2$) and a projection area (A) of the same, according to the following equation.

$$SF1=(ML^2/A)\times(\pi/4)\times 100 \quad (\pi\text{: circle ratio})$$

(Method of Measuring Molecular Weight and Molecular Weight Distribution of Resin)

In the invention, the molecular weight and the molecular weight distribution of the binder resin and the like are measured under the following conditions.

HLC-8120GPC, SC-8020 apparatus (manufactured by Tosoh Corp.) is used as GPC, two of TSKgel. Super HM-H (manufactured by Tosoh Corp.: 6.0 mm ID×15 cm) are used as the columns, and THF (tetrahydrofuran) is used as an eluant. Experiments are conducted using an IR detector, under the experimental conditions of a specimen concentration: 0.5%, flow rate: 0.6 ml/min, sample injection amount: 10 μl, and a measuring temperature: 40° C. The calibration line is obtained from 10 samples of "polystyrene standard samples TSK standard" manufactured by Tosoh Corp, i.e., "A-500", "F-1", "F-10", "F-80", "F-380", "A-2500" "F-4", "F-40", "F-128" and "F-700".

(Volume Average Particle Size of Fine Resin Particles, Colorant Particles, and the Like)

The volume average particle size of fine resin particles, colorant particles, and the like are measured by a laser diffraction-type particle size distribution measuring apparatus (LA-700, manufactured by Horiba, Ltd.).

(Method of Measuring Glass Transition Temperature of Resin)

The glass transition temperature (Tg) of an amorphous resin is determined according to ASTM D3418-8, by using a differential scanning calorimeter (DSC3110, thermal analysis system 001, manufactured by Mack Science Co.), by measuring under the condition of a temperature elevation rate: 10° C./min, from room temperature to 150° C. The glass transition temperature is defined as a temperature at an intersection of a base line and a line extended from a rising line at a heat adsorption section.

(Preparation of Each Dispersion Solution)

The toners used in Examples and Comparative Examples are obtained by: forming aggregated particles by preparing the following resin particle dispersion and the colorant dispersion, respectively, then mixing the dispersions at a predetermined proportion and stirring, adding a polymer of an inorganic metal salt containing at least aluminum to ionically neutralize: adjusting the pH in the system from weak acid to neutral with a chelating agent and an inorganic hydroxide, then heating the aggregated particles to a glass transition temperature of the resin particles or higher for fusion and coaleascing; and sufficiently cleaning, performing solid/liquid separation and drying.

-Resin Particle Dispersion 1-

Styrene (manufactured by Wako Pure chemical Industries Ltd.): 315 parts n-butyl acrylate (manufactured by Wako Pure chemical Industries Ltd.): 75 parts β-carboxyethyl acrylate (manufactured by Rhodia Nikka Co.): 9 parts 1'10-decanediol diacrylate (manufactured by Shin-Nakamura Chemical Industry Co.): 1.5 parts Dodecane thiol (manufactured by Wako Pure chemical Industries Ltd.): 2.7 parts The above are mixed and dissolved in 550 parts of ion exchanged water containing 4 parts of an anionic surfactant (Dowfax, manufactured by Dow Chemical Co.), further dispersed and emulsified in a flask, then 50 parts of ion exchanged water in which 6 parts of ammonium persulfate is dissolved is put therein while slowly stirring and mixing for 10 minutes.

Then, after thoroughly performing nitrogen substituting inside the system, the inside of the flask is heated by an oil bath until the temperature inside the system reaches 70° C. while stirring, then emulsion polymerization is continued for 6 hours. An anionic resin particle dispersion 1 is thus obtained, wherein the volume average particle size of the resin particles is 200 nm, the weight average molecular weight of the resin particle is 40,000 and the glass transition temperature thereof is 54.1° C.

-Resin Particle Dispersion 2-

A resin particle dispersion 2 is obtained in the same manner as the preparation of the particle dispersion 1, except that the amounts of styrene, n-butyl acrylate, and β-carboxyethyl acrylate are changed to 330 parts, 70 parts, and 9.5 parts respectively. The volume average particle size is 199 nm, the weight average molecular weight is 47,000, and the glass transition temperature is 58.8° C.

-Colorant Dispersion 1-

Phthalocyanine pigment (PVFASTBLUE, manufactured by Dainichi Seika Co.): 90 parts Anionic surfactant (Neogen SC, manufactured by Daiichi Kogyo Seiyaku Co. Ltd.): 10 parts Ion exchanged water: 240 parts After mixing and dispersing by a homogenizer (ULTRATURRAX T50, manufactured by IKA Co.) for 15 min, the above are put into a circulation-type supersonic dispersing machine (RUS-600 TCVP, manufactured by Nippon Seiki Seisakusho Co.) to prepare a colorant dispersion 1. The number average particle size of the colorant in the colorant dispersion 1 is 145 nm.

-Colorant Dispersion 2-

Carbon black (R330 manufactured by CABOT Co.): 90 parts

Anionic surfactant (Neogen SC, manufactured by Daiichi Kogyo Seiyaku Co. Ltd.): 10 parts Ion exchanged water: 240 parts The above are mixed and a colorant dispersion 2 is prepared under the same conditions as those for the colorant dispersion 1. The number average particle size of the colorant in the colorant dispersion 2 is 150 nm.

Example 1

(Production of Toner 1)

Ion exchanged water: 500 parts

Resin particle dispersion 1: 175 parts

Colorant dispersion 1: 35 parts

Coagulant (polyaluminum chloride, manufactured by Asada Kagaku Co.): 0.5 parts

The above ingredients are mixed and dispersed in a round stainless steel flask by a homogenizer (ULTRATURRAX T50, manufactured by IKA Co.) Then, the flask is heated by a heating oil bath to an aggregation temperature of 50° C. while stirring, and maintained for 30 minutes. The resultant are then heated to 52° C. and maintained for 1.5 hours. 25 parts of the resin particle dispersion 1 is moderately added to the thus prepared dispersion containing the aggregated particles and maintained at 53° C. for one hour by elevating the temperature of the heating oil bath.

Then, an Na salt of nitrilotriacetic acid (Chelest 70, manufactured by Chubu Chelest Co. Ltd.), a trivalent aminopolycarboxylic acid, is added as a chelating agent so that the amount thereof is 5% of the total amount of the liquid. After adding 1 mol/L of an aqueous solution of sodium hydroxide such that the pH in the system is 7.5, the stainless steel flask is tightly sealed. Then the resultant is moderately heated up to 85° C. while continuously stirring using a magnetic seal, thereafter heated up to 96° C. and 1 mol/L of an aqueous nitric acid solution is added until the pH becomes 5.0 and maintained for 5 hours.

After completion of the reaction, the resultant is cooled, filtrated and sufficiently washed with ion exchanged water, then dried by using a vacuum drier to obtain toner particles 1. 0.70 parts of hydrophobic silica (TS720, manufactured by CABOT Co.) is added to 100 parts of the toner particles and blended by using a Henschel mixer under the condition at 3000 rpm for 5 min at 20° C. The volume average particle size of the toner particles 1 is 5.3 μm and the volume particle size distribution index GSDv thereof is 1.23. The shape factor SF1 of the particles determined from the shape observed by a LUZEX image analyzer is 130. The aluminum content determined from measurement by XPS is 0.009 atm %.

(Preparation of Developer)

The toner is weighed, then stirred and mixed with a ferrite carrier with a volume average particle size of 50 μm coated with 1 mass % of polymethyl methacrylate (Mw: 76,000, manufactured by Soken Chemical Co.) in a ball mill for 5 min to prepare a developer (1). The toner concentration (the ratio of the toner relative to 100 of the developer) of the developer is 5%.

(Evaluation of Toner)

The developer (1) is charged in a color copier, DocuColor 1250 (manufactured by Fuji Xerox Co.), from which a fixing device is detached, and an unfixed image is printed so that the amount of the toner thereon is adjusted to 0.20 mg/cm$^2$. The printed images are a half-tone image having the size of 40 mm×40 mm and a kanji character of 2.8 mm length and 3.1 mm width as shown in FIG. 1. The paper for printing is a thick paper sheet (OK prince high quality paper, manufactured by Fuji Xerox Office Supply Co., Ltd.) which can be used as a poster board.

In the fixing of images, a fixing device that has been taken out from the DocuColor 1250 copier and modified such that the roll temperature of the fixing device can be changed is used. The surface material of a fixing role is changed to a Teflon (registered trade mark) tube. The paper conveying speed of the fixing device is set to 160 mm/sec.

Under the above conditions, unfixed images are fixed at the temperatures of the fixing device appropriately varying from 140° C. to 210° C. at intervals of 5° C., and thus obtaining the fixed images.

-Image Glossiness-

Measurement for image glossiness is conducted according to JIS Z 8741, and a maximum glossiness is shown for the image with no occurrence of offset. The incidence angle for the measurement is 75° and a Gloss Meter GM-26D (MURAKAMI COLOR RESEARCH LABORATORY CO., Ltd.) is used.

The evaluation for the image glossiness is ranked as below.

A: glossiness is 90% or more

B: glossiness is from 80 to less than 90%

C: glossiness is from 70 to less than 80%

D: glossiness is less than 70%

-Gloss Unevenness-

Gloss unevenness of the fixed images (half-tone) is evaluated, at the fixing temperature at which the image glossiness is maximized, with the naked eye in accordance with the following criterion.

A: image roughness is not observed at all

B: image roughness is slightly observed.

C: image roughness is observed but with no practical problem

D: image roughness is distinctly observed.

-Anti-Offset Properties-

The images with the temperature at which hot offset occurs is not more than 200° C. are evaluated satisfactory.

-Fine Line Reproduction-

Defacing of the kanji character shown in FIG. 1 is observed with the naked eye at a fixing temperature that is 5° C. lower than the lowest temperature at which the offset described above occurs (observed at 210° C. when offset does not occur at 210° C.)

A: Having excellent fine line reproduction

B: Having poor fine line reproducibility but with no problem

C: Having poor reproduction which could cause a problem.

The results are shown in Table 1.

Example 2

The toner 2 and the developer (2) are prepared in the same manner as in Example 1 except that the amount of the chelating agent is changed to 2%, and evaluated.

The characteristics of the toner and the result of the evaluation are shown in Table 1.

Example 3

The toner 3 and the developer (3) are prepared in the same manner as in Example 1 except that the amount of the chelating agent is changed to 1%, and evaluated.

The characteristics of the toner and the result of the evaluation are shown in Table 1.

Example 4

The toner 4 and the developer (4) are prepared and evaluated in the same manner as in Example 1 except that the resin particle dispersion 2, the colorant dispersion 2, and aluminum sulfide as a coagulant are used instead of the resin particle dispersion 1, the colorant dispersion 1, and polyaluminum chloride as a coagulant, respectively.

The characteristics of the toner and the result of the evaluation are shown in Table 1.

Example 5

The toner 5 and the developer (5) are prepared and evaluated in the same manner as in Example 1 except that 1% of an Na salt of triethylene tetraamine hexaacetic acid (Chelest Q, manufactured by Chubu Chelest Co.) as a hexavalent aminopolycarboxylic acid instead of the trivalent aminopolycarboxylic acid as the chelating agent.

The characteristics of the toner and the result of the evaluation are shown in Table 1.

Example 6

Toner 6 and the developer (6) are prepared in the same manner as in Example 5 except that the amount of the chelating agent is changed to 8%, and evaluated.

The characteristics of the toner and the result of the evaluation are shown in Table 1.

Example 7

The toner 7 and the developer (7) are prepared in the same manner as in Example 5 except that the amount of the chelating agent is changed to 15%, and evaluated.

The characteristics of the toner and the result of the evaluation are shown in Table 1.

Example 8

The toner 8 and the developer (8) are prepared and evaluated in the same manner as in Example 5 except that the resin particle dispersion 2, the colorant dispersion 2, and aluminum sulfide as a coagulant are used instead of the resin particle dispersion 1, the colorant dispersion 1, and polyaluminum chloride as a coagulant, respectively.

The characteristics of the toner and the result of the evaluation are shown in Table 1.

Example 9

The toner 9 and the developer (9) are prepared in the same manner as in Example 5 except that the amount of the chelating agent is changed to 0.08%, and evaluated.

The characteristics of the toner and the result of the evaluation are shown in Table 1.

Example 10

The toner 10 and the developer (10) are prepared in the same manner as in Example 5 except that the amount of the chelating agent is changed to 20% and evaluated.

The characteristics of the toner and the result of the evaluation are shown in Table 1.

Comparative Example 1

The toner 11 and the developer (11) are prepared in the same manner as in Example 1 except that the amount of the chelating agent is changed to 10% and evaluated.

The characteristics of the toner and the result of the evaluation are shown in Table 1.

Comparative Example 2

The toner 12 and the developer (12) are prepared in the same manner as in Example 1 except that the amount of the chelating agent is changed to 0.05% and evaluated.

The characteristics of the toner and the result of the evaluation are shown in Table 1.

TABLE 1

| | | | | | XPS analysis | Pyrogenic gas chromatography hexavalent | Fixed image | | | |
|---|---|---|---|---|---|---|---|---|---|---|
| | Developer (toner) | D50v (μm) | GSDv | SF1 | Amount of Al (atm %) | aminopolycarboxylic acid (mass %) | Image glossiness | Gloss unevenness | fine-line reproducibility | Offset resistance |
| Example 1 | (1) | 5.3 | 1.23 | 130 | 0.009 | — | A | B | C | 210° C. or more |
| Example 2 | (2) | 5.4 | 1.21 | 134 | 0.013 | — | A | B | C | 210° C. or more |
| Example 3 | (3) | 5.3 | 1.22 | 129 | 0.018 | — | C | C | C | 210° C. or more |
| Example 4 | (4) | 5.4 | 1.22 | 131 | 0.017 | — | B | C | C | 210° C. or more |
| Example 5 | (5) | 5.3 | 1.21 | 133 | 0.018 | 0.5 | B | A | B | 210° C. or more |
| Example 6 | (6) | 5.4 | 1.20 | 132 | 0.008 | 4.0 | A | A | A | 210° C. or more |

TABLE 1-continued

| | Developer (toner) | D50v (μm) | GSDv | SF1 | XPS analysis Amount of Al (atm %) | Pyrogenic gas chromatography hexavalent aminopolycarboxylic acid (mass %) | Fixed image Image glossiness | Gloss unevenness | fine-line reproducibility | Offset resistance |
|---|---|---|---|---|---|---|---|---|---|---|
| Example 7 | (7) | 5.3 | 1.20 | 132 | 0.006 | 8.0 | A | B | A | 210° C. |
| Example 8 | (8) | 5.4 | 1.22 | 135 | 0.018 | 0.5 | B | A | B | 210° C. or more |
| Example 9 | (9) | 5.3 | 1.20 | 133 | 0.019 | 0.05 | C | B | A | 210° C. or more |
| Example 10 | (10) | 5.3 | 1.21 | 132 | 0.005 | 13 | A | B | C | 205° C. |
| Comparative Example 1 | (11) | 5.3 | 1.21 | 134 | 0.003 | — | A | B | D | 180° C. |
| Comparative Example 2 | (12) | 5.3 | 1.22 | 130 | 0.031 | — | B | D | A | 210° C. or more |

As shown in Table 1, each of the toners in Examples 1 to 10 exhibits high glossiness and no gloss unevenness in a half-tone image and favorable offset resistance. The toners that contain the hexavalent aminopolycarboxylic acid also have excellent fine line reproducibility.

On the other hand, hot offset occurs in the case of the toner of Comparative Example 1, in which the amount of the aluminum exceeds a desired range, although gloss unevenness does not occur. Further, in the case of the toner of Comparative Example 2, in which the amount of the aluminum is below the desired range, gloss unevenness in a half-tone image is generated.

All publications, patent applications, and technical standards mentioned in this specification are herein incorporated by reference to the same extent as if each individual publication, patent application, or technical standard was specifically and individually indicated to be incorporated by reference.

What is claimed is:

1. A toner for electrostatic image development comprising a binder resin, a colorant and a hexavalent aminopolycarboxylic acid derivative, the toner having a content of an aluminum element with respect to carbon of approximately 0.005 atm % to approximately 0.02 atm % as measured by X-ray photo-electron spectroscopy at a depth of about 0.01 μm to 0.5 μm.

2. The toner for electrostatic image development according to claim 1, wherein the amount of the hexavalent aminopolycarboxylic acid derivative as measured by pyrogenic gas chromatography mass spectroscopy being in a range of from approximately 0.1 mass % to approximately 10 mass %.

3. The toner for electrostatic image development according to claim 1, wherein the toner further comprises an amorphous resin and a crystalline resin.

4. The toner for electrostatic image development according to claim 3, wherein the melting point of the crystalline resin is in a range of from approximately 50.degree. C. to approximately 120.degree. C.

5. The toner for electrostatic image development according to claim 3, wherein an addition amount of the colorant is in a range of from approximately 4 mass % to approximately 15 mass % with respect to the total mass of the toner.

6. The toner for electrostatic image development according to claim 1, wherein the toner further comprises a releasing agent, the amount of the releasing agent being from approximately 5 parts by mass to approximately 25 parts by mass with respect to 100 parts by mass of the binder resin.

7. The toner for electrostatic image development according to claim 1, wherein the volume average particle size of the toner is in a range of from approximately 3 .mu.m to approximately 9 .mu.m.

8. The toner for electrostatic image development according to claim 1, wherein a volume average particle size distribution index GSDv of the toner is approximately 1.30 or less.

9. The toner for electrostatic image development according to claim 1, wherein the ratio GSDv/GSDp, where GSDv is a volume average particle size distribution index of the toner and GSDp is a number average particle size distribution index, is approximately 0.95 or more.

10. The toner for electrostatic image development according to claim 1, wherein a shape factor SF1 of the toner is in a range of from approximately 110 to approximately 145.

11. A production method for the toner for electrostatic image development according to claim 1, the method comprising an aggregation process of mixing at least one resin particle dispersion and at least one colorant dispersion and elevating the temperature of the mixture under the presence of an aluminum ion to form aggregated particles, and a fusing process of heating the aggregated particles to a temperature higher than the glass transition temperature of the resin particles to allow the aggregated particles to fuse and coalesce to form toner particles, wherein a hexavalent aminopolycarboxilic acid derivative is added after completion of the temperature elevation in the aggregation process.

12. A developer comprising the toner for electrostatic image development according to claim 1.

13. An image forming method comprising a latent image forming process of forming a latent image on a surface of an electrostatic image support, a developing process of developing the latent image on the surface of the electrostatic image support with a developer containing a toner to obtain a toner image, a transfer process of transferring the toner image onto a surface of an image receiving medium, and a fixing step of thermally fixing the transferred toner image on the surface of the image receiving medium, wherein the toner contained in the developer is the toner for electrostatic image development according to claim 1.

14. The toner for electrostatic image development according to claim 1, wherein the content of the aluminum element is substantially the same throughout the toner.

* * * * *